United States Patent [19]

Aronhalt

[11] 4,219,052

[45] Aug. 26, 1980

[54] BALE TIE STRAIGHTENER

[75] Inventor: Herman L. Aronhalt, Uniontown, Pa.

[73] Assignee: Cavert Wire Company, Inc., Uniontown, Pa.

[21] Appl. No.: 20,345

[22] Filed: Mar. 12, 1979

[51] Int. Cl.[3] ..... B21F 11/00

[52] U.S. Cl. ..... 140/140; 140/73

[58] Field of Search ..... 140/73, 139, 140; 83/371

[56] References Cited

U.S. PATENT DOCUMENTS 3,893,316 7/1975 Simich ..... 140/140

*Primary Examiner*—Lowell A. Larson

*Attorney, Agent, or Firm*—Webb, Burden, Robinson & Webb

[57] ABSTRACT

An improved apparatus for straightening and cutting a used wire bale tie having one fastening end removed includes means for feeding, straightening and cutting the bale tie. The improvement in the apparatus involves providing an engaging means for the engagement of the bale tie fastening end to limit the feeding of the bale tie into the straightening means. The engagement of the bale tie fastening end with the engaging means activates the cutting means to cut the bale tie to a predetermined length. Means for withdrawing the bale tie from the straightening means is activated by an activation means associated with the cutting of the bale tie. The invention also includes a method of straightening wire bale ties having one fastening end removed.

10 Claims, 6 Drawing Figures

BALE TIE STRAIGHTENER

BACKGROUND OF THE INVENTION

1. Field of the Invention

This invention relates to a method and apparatus for straightening and cutting once used bale ties and more particularly to a method and apparatus for straightening and cutting once used bale ties having one fastening end removed.

2. Description of the Prior Art

Wire bale ties are wires which have opposing fastening ends wherein the wire is wrapped about a compressed material and the fastening ends are interengaged. There are several types of bale ties, the wire bale ties differentiating only in the types of fastening ends utilized. One preferred type of bale tie is one having a loop at one end and a cross head at the opposing end and known as a "cross head" bale tie.

One particularly common use of bale ties, and particularly the cross head bale ties, is in the harvesting and shipping of cotton and the like materials. The farmer brings the cotton to a gin mill, the cotton is processed, compressed and bale ties are disposed thereabout and the bale transported to a warehouse. At the warehouse the bale ties are removed and the cotton is further compressed to form a smaller bale and shorter bale ties are disposed thereabout. It is desirable to reuse the bale ties disposed about the initially compressed cotton by cutting them to a shorter length and disposing them about the fully compressed bale.

Several methods of reusing these once used bale ties have been proposed and used, some of them involving cutting both fastening ends from the bale tie, cutting the bale wire to the desired length, straightening the bale tie wire and reheading the wire to form a shorter bale tie.

Exemplary of such straightening and/or cutting apparatus are U.S. Pat. Nos. 3,893,316; 2,505,209; 1,466,344 and 761,231.

Although many of the proposed apparatus use manual straightening techniques, mechanical straighteners such as those disclosed in U.S. Pat. Nos. 3,893,316 and 1,751,094 are useful.

In accordance with the present invention a method for straightening once used wire bale ties is provided which involves removing one fastening end, straightening the bale tie wire and cutting it to length. After the bale tie is straightened the removed fastening end is reformed on the bale tie and the shortened bale tie is ready for reuse. An apparatus to accomplish the method is also provided.

BRIEF DESCRIPTION OF THE INVENTION

An improved apparatus for straightening and cutting a used wire bale tie having one fastening end removed includes means for feeding, straightening and cutting the bale tie. The improvement in the apparatus involves providing an engaging means for the engagement of the bale tie fastening end to limit the feeding of the bale tie into the straightening means. The engagement of the bale tie fastening end with the engaging means activates the cutting means to cut the bale tie to a predetermined length. Means for withdrawing the bale tie from the straightening means is activated by an activation means associated with the cutting of the bale tie. The invention also includes a method of straightening wire bale ties having one fastening end removed.

In operation, a once used bale tie is fed by drive rollers through straightening rollers which straighten the bale tie. The bale tie which has one fastening end removed and its second fastening end remaining, traverses through the straightening apparatus and its travel is limited by the retained fastening end engaging the engaging means at the entrance to the machine. The engagement of the bale tie fastening end with the engaging means causes a switch to activate the cutter which cuts the bale tie to a predetermined length. The cutter, after it has cut the bale tie to the predetermined length, activates a switch which reverses the direction of the feed drive rollers and discharges the straightened bale tie from the machine. The straightened bale tie is then placed in an appropriate forming machine to reform the fastening end that was removed.

The following drawings will further illustrate the process and apparatus of the invention.

DETAILED DESCRIPTION OF THE DRAWINGS

Figure 1:
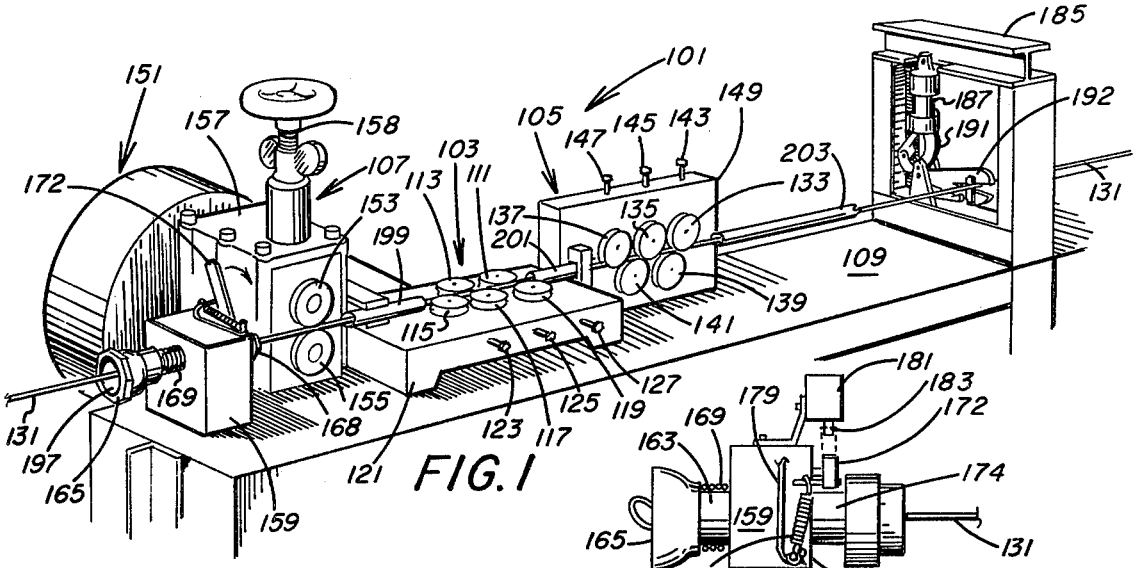
FIG. 1 is a perspective view of a bale tie straightener of the invention.

Referring now to the drawings wherein like reference numerals refer to like parts, there is shown a wire bale tie straightening and cutting apparatus generally designated by the numeral 101 mounted on a working platform 109. The bale tie cutting and straightening unit has a first straightening unit 103, a second straightening unit 105 and a drive roller assembly 107 mounted on the working platform 109. The first straightening unit is composed of five free wheeling rollers 111, 113, 115, 117 and 119 which have their axes perpendicular to platform 109. The rollers are mounted on support block 121 which is in turn fixed to working platform 109. The rollers 115, 117 and 119 are spaced apart from rollers 113 and 111. These rollers act to straighten the wire by bending it in a single plane. The rollers 115, 117 and 119 are adjustable in proximity from the rollers 113 and 111 by adjusting screws 123, 125 and 127. By adjusting the screws 123, 125 and 127 the rollers can be moved inwardly or outwardly to adjust the space between these rollers and rollers 111 and 113 to provide proper straightening of a bale tie wire 131.

The second straightener unit 105 is identical to the first straightener unit except that the axes of the straightening rollers 133, 135, 137, 139 and 141 are parallel to the plane of the platform 109. Further, the adjusting screws 143, 145 and 147 mounted in support block 149 adjust rollers 137, 135 and 133 as previously described with reference to first straightener unit 103. The rollers of the second straightener unit 105 act to straighten the wire by bending it in a single plane perpendicular to the bending plane imparted by straightener unit 103.

The first and second straightener units 103 and 105 are arranged so that the passage between rollers of a straightener unit are along the same line as the passage between rollers of the other straightener unit. The drive or feed unit 107 is composed of the motor and power transmission assembly 151 and the rollers 153 and 155. The rollers 153 and 155 are driven by shafts not shown which traverse the housing 157 upon which the rollers 153 and 155 are mounted. Both rollers 153 and 155 are positively driven. Compression adjusting screw arm 158 is used to regulate the compressive force exerted on the bale tie 131 by the rollers 153 and 155. The tangential contact of rollers 153 and 155 is along the same line as the spaces between the opposing roller straightening units 103 and 105.

Ahead of the drive or feed unit 107 is mounted feedblock 159 which has an annular opening 161 extending therethrough and the bearing surface 162 along the periphery of the opening 161. Mounted within feedblock 159 is sleeve 163 which extends through feedblock 159 and the periphery of which engages bearing surface 162 in slidable engagement. The sleeve 163 has mounted thereon an end cup 165 for receiving and contacting bale tie end 167. On the opposing end of sleeve 163 is mounted annular flange 168 which has a diameter greater than sleeve 163 to prevent retraction of the sleeve 163 from bearing surface 162. A spring 169 is interposed between cup 165 and block 159 to force the flange 168 against block interior 171. Actuating lever 172 is pivotally mounted on the block 159 by pin 173. In a static position the sleeve 163 is in the forward position and lever 172 rides on flange 168 and is in frictional engagement therewith by force of spring 175 mounted at one end to lever 172 and on the opposing end to pin 177 extending from block 159. Overtravel of the pin is prevented by hasp 179 mounted on pin 177 and terminating at the opposing end in a hook for engagement of the lever arm 172.

Figure 4:
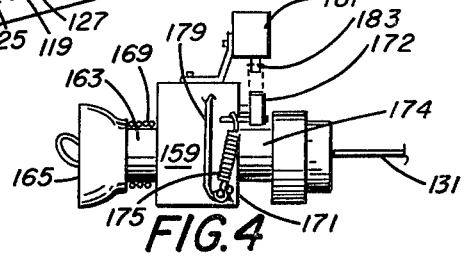
FIG. 4 is a top view of the mechanism shown in FIG. 3.
Figure 2:
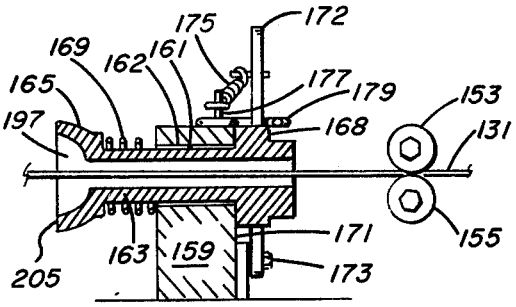
FIG. 2 is a cross-sectional side view of the switching mechanism used to activate the cutter.
Figure 3:
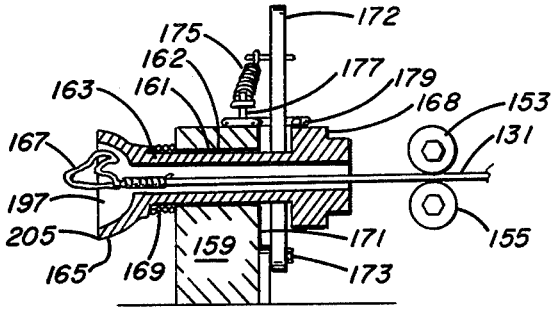
FIG. 3 is a cross-sectional side view of the mechanism used to activate the cutter, in the activating position.

FIG. 2 shows the cutter actuating mechanism in an open position, i.e. not activating the cutter head. FIG. 3 shows the actuating mechanism engaged, i.e. actuating the cutter head, and FIG. 4 is a top view thereof. Referring now particularly to FIG. 4, there is a contact switch 181 with contact point 183 extending therefrom. In the position when the cutting mechanism is not actuated, the switch 181 is engaged. In actuating the cutting mechanism the switch is disengaged by the lever 172 disengaging contact point 183 and being pulled inwardly against bearing surface 174 of the sleeve 163.

Figure 5:
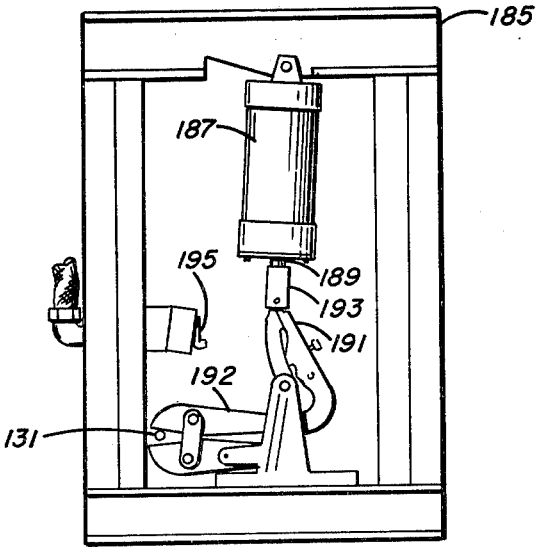
FIG. 5 is a rear view of the cutting mechanism with the cutting blades disengaged.
Figure 6:
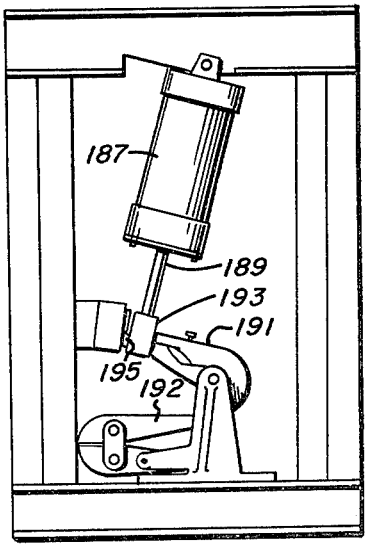
FIG. 6 is a rear view of the cutting mechanism with the cutting blades engaged and the bale tie withdrawal activating means engaged.

Referring now to FIGS. 5 and 6, the cutting mechanism of the bale tie is shown. The mechanism is mounted on a frame 185 which is in turn in communication with the platform 109. Pneumatic cylinder 187 exerts pneumatic force when the cutter is activated by extending shaft 189 moving lever arm 191 downwardly and pivoting bolt cutters 192 to a closed position. Contact block 193 engages contact point 195 which reverses the direction of motor and transmission assembly 151.

In operation, a once used bale tie has one of the fastening ends removed. In the embodiment shown in the drawings, the wire bale tie 131 has the looped end removed and the cross head remaining at the opposing end. The once used bale tie 131 is inserted in opening 197 of sleeve 163. The bale tie operator must assure that the lever 172 is in the position shown in FIG. 2. The drive or feed roller mechanism 107 is activated by turning on motor and transmission assembly 151, causing roller 153 to turn in the counterclockwise direction and roller 155 to turn in the clockwise direction. The bale tie end which had the fastening end removed engages the rollers 153 and 155 and is driven through guide 199 and straightened in one direction by straightening unit 103. The bale tie end then passes through second guide 201 and is striaghtened in a second direction in straightening unit 105. The bale tie then passes through third guide 203 which extends from the end of second straightening unit 105 to the bolt cutters 192. The end of the bale tie 131 traverses past cutter 192 and is continued to be driven until bale tie end 167 engages cup 165. When bale tie end 167 engages cup 165 the force exerted by feed rollers 153 and 155 pulls the sleeve 163 forward and annular flange 168 is spaced apart from feedblock 159 allowing lever 172 to engage bearing surface 174 of sleeve 163 and disengage contact point 183. When contact 183 is disengaged, it activates pneumatic cylinder 187 which extends shaft 189, pivoting lever 191 closing the blades of the cutters 192 thereby severing the bale tie to a predetermined length governed by the distance between the end 205 of the cup 165 and the cutters 192. When the cutting blades are in closed position the contact block 193 engages contact point 195 switching the motor and drive assembly 151 to the reverse position causing the roller 153 to rotate in the clockwise direction and the roller 155 to rotate in the counterclockwise direction thereby withdrawing the bale tie 131 from the cutting and straightening apparatus.

After the bale tie has been cut to a predetermined length a second fastening end is then formed thereon and a straightened bale tie of predetermined length is ready for use. As can be seen from the method and apparatus disclosed herein, any bale tie may be used so long as it has a single fastening end retained and has no fastening end on the opposing end. Thus cross head bale ties, looped end bale ties or similar wire bale ties may be cut and straightened in accordance with the apparatus and process of the invention.

Although the invention has been described with reference to specific apparatus and specific steps, it is only to be limited as is set forth in the accompanying claims.

I claim:

1. In an apparatus for straightening and cutting a used wire bale tie having one fastening end removed, including means for straightening the bale tie, means for feeding the bale tie into said straightening means, and means for cutting the bale tie to a predetermined length the improvement comprising:

means for engaging the bale tie at the fastening end to limit the feeding of the bale tie into the straightening means;

means for activating said cutting means by the engagement of the bale tie at the fastening end with said engaging means;

means for withdrawing said bale tie from said straightening means; and means for activating said withdrawing means activated by the cutting of said bale tie to a predetermined length.

2. The apparatus of claim 1 wherein said means for engaging said bale tie at the fastening end includes a stop having a central passage therethrough for traversal of the bale tie wire therethrough.

3. The apparatus of claim 2 wherein said means for activating said cutting means includes a spring mounted on said stop which compresses upon engagement with the bale tie end and a switch which is activated by the compression of said spring.

4. The apparatus of claim 1 wherein said means for activating said withdrawing means includes a switch activated by the travel of said cutting means.

5. The apparatus of claim 1 wherein said withdrawing means includes the reversal of said feeding means.

6. In the method of straightening and cutting a used wire bale tie having one fastening end removed, including feeding said wire into a straightener, straightening the wire, and cutting the wire to a predetermined length the improvement comprising:

engaging the bale tie at the fastening end to limit the feeding of the bale tie into the straightener;

activating the cutter by the engagement of the bale tie at the fastening end;

activating a withdrawing means by the cutting of the bale tie; and withdrawing the bale tie from the straightener.

7. The method of claim 6 wherein said engaging step includes engaging the bale tie at the fastening end with a stop.

8. The method of claim 7 wherein said activating of the cutter includes compressing a spring mounted on a stop and activating a switch by said compression.

9. The method of claim 6 wherein activating of the withdrawing means is a switch activated by the cutter.

10. The method of claim 9 wherein said withdrawing includes the reversal of the feeding.

* * * * *